US011752655B2

(12) United States Patent
Whetter

(10) Patent No.: US 11,752,655 B2
(45) Date of Patent: Sep. 12, 2023

(54) CUTTING GUIDE

(71) Applicant: Whetter's Wood Products LLC, Everson, WA (US)

(72) Inventor: Robert Steven Whetter, Sumas, WA (US)

( * ) Notice: Subject to any disclaimer, the term of this patent is extended or adjusted under 35 U.S.C. 154(b) by 0 days.

(21) Appl. No.: 17/668,608

(22) Filed: Feb. 10, 2022

(65) Prior Publication Data

US 2022/0266471 A1 Aug. 25, 2022

Related U.S. Application Data

(60) Provisional application No. 63/148,534, filed on Feb. 11, 2021.

(51) Int. Cl.
*B27B 27/08* (2006.01)

(52) U.S. Cl.
CPC ..... *B27B 27/08* (2013.01)

(58) Field of Classification Search
CPC ... B27B 27/08; B27B 17/0025; B23D 59/001; B23D 57/023; B23Q 17/24; Y10S 33/21
USPC .... 83/451, 522.16, 473, 477.2, 520; 30/123, 30/337, 390, 505, 383, 700; 33/286, 485, 33/630, 241, 262, 263, 574, 577, 628
See application file for complete search history.

(56) References Cited

U.S. PATENT DOCUMENTS 4,319,404 A * 3/1982 Brock ..... B27B 17/0025 33/630
4,984,371 A * 1/1991 Fredrickson ..... B23Q 17/24 33/630
6,035,757 A * 3/2000 Caluori ..... B23Q 17/24 83/520
6,295,738 B1 10/2001 Risch
2002/0069542 A1 6/2002 Musacchia
2006/0277775 A1 12/2006 Isele et al.
2008/0244910 A1 10/2008 Patel
2011/0197458 A1 8/2011 Karrar et al.
2012/0048090 A1 3/2012 Etter et al.
2012/0255414 A1 10/2012 Koegel
2022/0297212 A1 * 9/2022 Clark ..... B27B 17/0025

FOREIGN PATENT DOCUMENTS

DE 102013111128 A1 * 4/2015 ..... B27B 17/0025
WO 2005118206 A3 1/2007

* cited by examiner

*Primary Examiner* — Ghassem Alie

(74) *Attorney, Agent, or Firm* — Elizabeth Reilly; Patentpending, PLLC

(57) ABSTRACT

A cutting guide for a saw includes a blade lying in a cutting plane. The cutting guide includes a bracket configured to be removably rotationally attached to the saw. The bracket includes a light clamp, a saw clamp, and a light emitter contained therein a sealed housing. The saw clamp is configured to removably rotationally attach the bracket to the saw, and the light emitter is removably attached to the bracket via the light clamp. The saw clamp is configured to rotate the light emitter in a pivot plane about a pivot axis parallel to the cutting plane. The saw clamp includes a first portion and a second portion each configured with female cylindrical surfaces to clamp to a grasping handle of the saw. The light clamp is a compression clamp configured to hold the light emitter in place. The light emitter includes a laser.

8 Claims, 2 Drawing Sheets

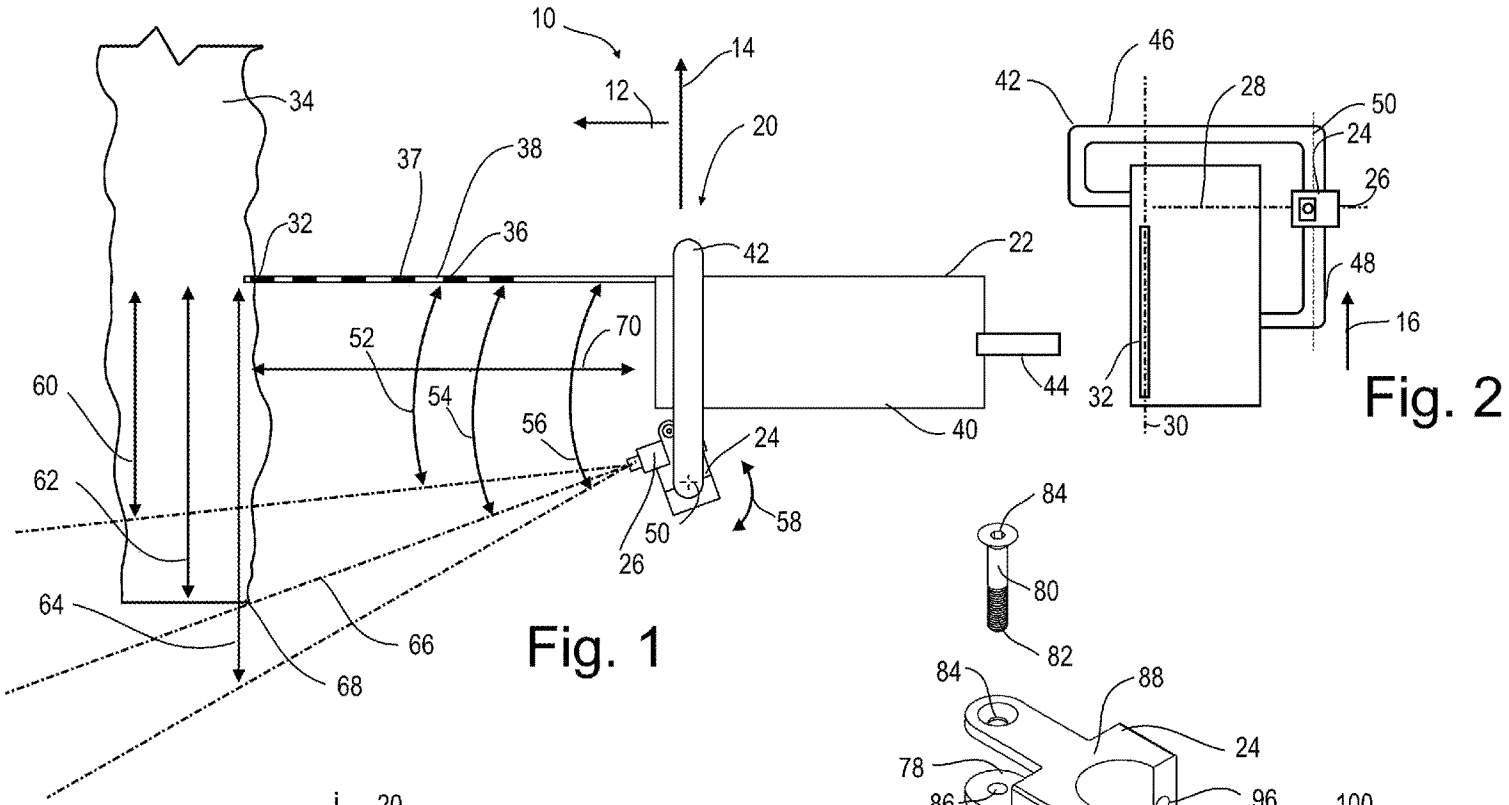
Fig. 1
Fig. 2
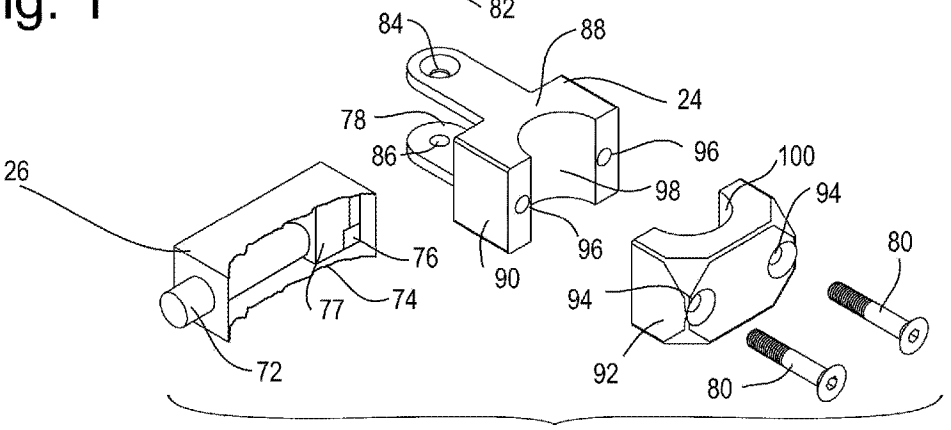
Fig. 4
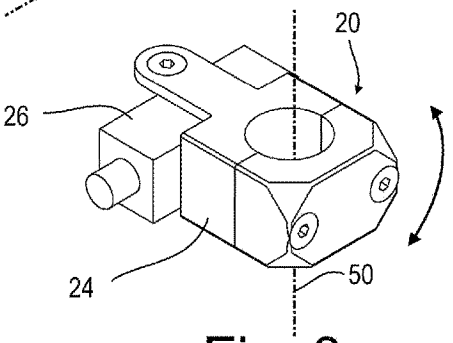
Fig. 3

CUTTING GUIDE

RELATED APPLICATIONS

This application claims priority of U.S. Provisional Patent Application Ser. No. 63/148,534 filed on Feb. 11, 2021, incorporated herein by reference.

BACKGROUND OF THE DISCLOSURE

Field of the Disclosure

Disclosed herein is a cutting guide configured to be mounted to a saw to facilitate accurate repeated cutting of material to a specified length.

BRIEF SUMMARY OF THE DISCLOSURE

Disclosed herein is a cutting guide for a saw or similar tool having a blade or other structure lying in a cutting plane. The cutting guide defined by a plane of operation of the saw, such as the plane the saw blade passed to cut. Also included is a bracket configured to be rotatably attached to the saw; the bracket comprising a light clamp and a saw clamp; a light emitter removably attached to the bracket; the bracket configured to rotate the light emitter in a pivot plane about a pivot axis parallel to the cutting plane.

The cutting guide may be arranged wherein the saw is a chain saw comprising a motor, a chain bar, and the blade comprising a chain with cutting teeth.

The cutting guide may be arranged wherein the pivot axis is a grasping handle of the saw.

The cutting guide may be arranged wherein the bracket comprises a compression handle clamp configured to clamp to the grasping handle of the saw.

The cutting guide may be arranged wherein the bracket comprises a compression light clamp configured to hold the light emitter in place.

A method for cutting an item to a prescribed length is also disclosed. The method comprising the steps of: providing the cutting guide as disclosed above; determining a desired cutting length; determining a desired cutting angle of the cutting guide relative to the saw based on the desired cutting length, rotationally adjusting the cutting guide to a rotation angle representative of the desired cutting length, turning on the light emitter, aligning the saw such that the light emitter projects light on the distal end of the item to be cut, and moving the saw in a cutting plane so as to cut the item to the desired cutting length

BRIEF DESCRIPTION OF THE SEVERAL VIEWS OF THE DRAWINGS

FIG. 1 is a top environmental view of one example of the disclosed cutting guide attached to one example of a saw while cutting a log.

FIG. 2 is a front view of the apparatus shown in FIG. 1.

FIG. 3 is an enlarged top isometric view of the example shown in FIG. 1 removed from the saw.

FIG. 4 is a partially exploded view of the example shown in FIG. 3.

DETAILED DESCRIPTION OF THE DISCLOSURE

Figure 5:
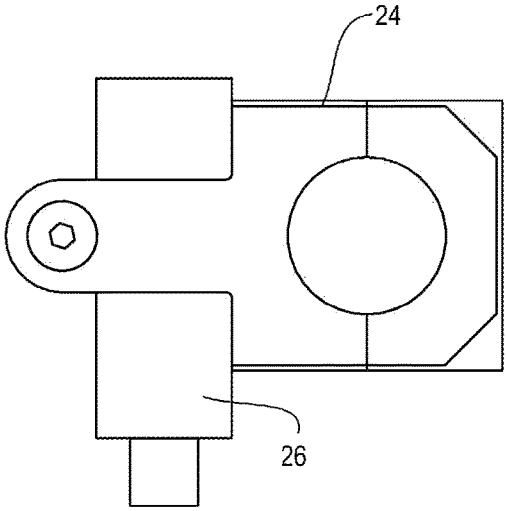
FIG. 5 is a top view of the apparatus shown in FIG. 3.
Figure 6:
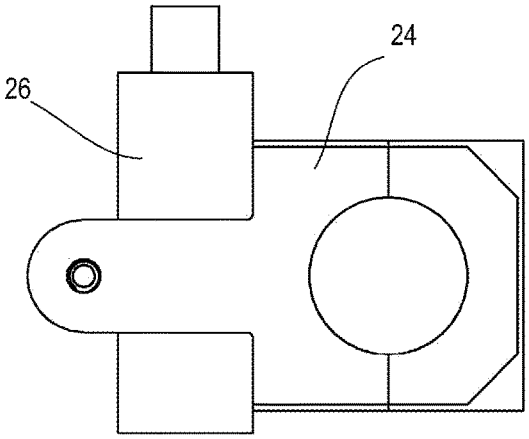
FIG. 6 is a bottom view of the apparatus shown in FIG. 3.
Figure 7:
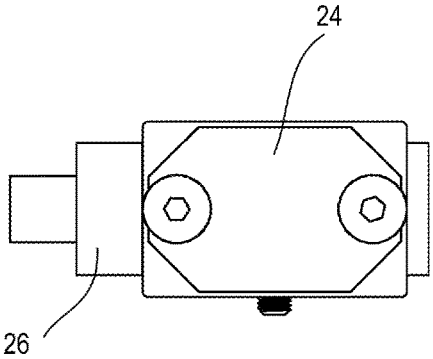
FIG. 7 is a side view of the apparatus shown in FIG. 3.
Figure 8:
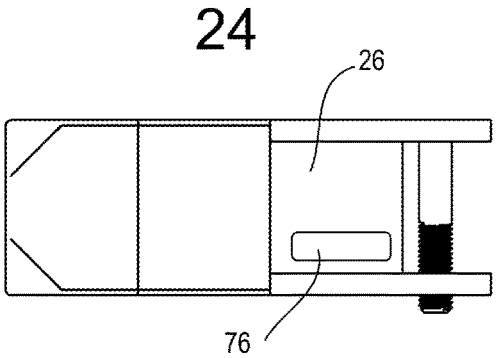
FIG. 8 is a side view of the apparatus shown in FIG. 7 from the opposing side.

In the field of cutting, where repeated cuts of the same length are to be made, it is common to set up a rigid cutting stop such as disclosed in U.S. Pat. No. 6,854,372B2. In such an application, the stop (e.g., 40*a*, 40*b*) is attached to the table upon which the item to be cut rests, the saw is movably attached to the table. The end of the item is abutted against the stop and as the saw is moved to cut the item to a predetermined length, each length is substantially identical. In such examples, the stop and the saw are both attached to a table or equivalent support.

Other cutting guides provide a laser or other light emitter which is aligned with the cutting plane so as to indicate to a user where a cut will be made. One such example is shown in U.S. Pat. No. 7,226,179B2. Before a user can use a guide such as this, the item to be cut must be marked at the point to be cut, or a fixed stop may be used as shown in U.S. Pat. No. 6,854,372B2 so that the user can properly cut the item. Where the item is to be cut into multiple equal lengths, separate measuring and cutting actions slow down operation and is inefficient.

When cutting a log into firewood lengths for example which cannot easily be positioned on a cutting table, a user will often have a measuring implement such as a tape measure or stick, and use this measuring implement to mark off lengths on the log by way of an axe, chalk, paint, or other apparatus. The user or another operator will then cut the log at each of these marks. The saw is moved along the log, rather than the log moved along the saw.

Disclosed herein is a cutting guide 20 which is configured to facilitate quick, easy, convenient, efficient, and relatively accurate repeated cuts in an item to be cut. Perfectly accurate cuts are not necessary in firewood cutting, as they are in, for example cabinet making. Looking to FIG. 1 is shown a top view of one example of the cutting guide 20 attached to a saw 22 which in this example is a chainsaw. Such chainsaws are known in the art. A chainsaw (or chain saw) is a portable gasoline-, electric-, or battery-powered saw that cuts with a set of teeth attached to a rotating chain driven along a guide bar. It is used in activities such as tree felling, limbing, bucking, pruning, cutting firebreaks in wildland fire suppression, and harvesting of firewood.

In one example, as shown in FIG. 1, the cutting guide 20 is configured to be adjustable by adjusting the relative angle (rotational position) of the cutting guide 20 relative to the saw 22 or cutting plane 30. By adjusting the rotational position, the item 34 may be cut into various lengths with repeated accuracy.

An axes system is established in this disclosure to assist in description. While the apparatus disclosed herein is not confined to a specific orientation, it has been found that using a common axes system 10 can aid in description. This common axes system 10 including a longitudinal axis 12 parallel to a cutting plane, a lateral axis 14 orthogonal to the cutting plane 30, and a transverse axis 16 also parallel to the cutting plane 30 and a pivot axis 50.

One substantial advantage of the cutting guide 20 disclosed herein is that it uses existing structure of the saw 22 to attach to and from the pivot axis. In one example this technical improvement means that the cutting guide 20 may be easily attached and removed from many different tools without modification of the tool (e.g., saw 22).

In the example shown in FIG. 3, the cutting guide 20 comprises a bracket 24 configured to be attached to the tool (saw 22) and a light emitter 26 configured to be removably attached to the bracket 24. In one example this allows for easy replacement of the light emitter 26 without replacing or removing the bracket 24 from the saw 22.

The bracket 24 is configured to attach to the saw 22 and the light emitter 26 attached to the bracket 24 such that the light emitter 26 emits light onto the item to be cut at a position laterally offset from the cutting plane. When so attached, the cutting guide 20 can be adjusted/pivoted in a pivot plane 28 as desired to cut different and repeated lengths as shown in FIG. 1 and described below. The pivot plane 28 of this example is orthogonal to the cutting plane 30 defined by a blade 32 of the saw 22. Wien cutting, the blade 32 is moved in the cutting plane 30 (commonly a vertical plane) to cut the item 34 which is to be cut. In this example, the item 34 is a wood log to be cut for firewood. So that the cut section will fall away from the remaining portion, the cutting plane is normally substantially vertical. The saw 22 is a chainsaw, with the blade 32 comprising a chain 36 having cutting teeth 37 which traverses a bar 38. A motor 40 is provided to move the chain 36 relative to the bar 38. Where the saw 22 is a hand-held saw, a grasping handle or handles are generally provided. In this example the saw 22 comprises a front handle 42 and a rear handle 44. FIG. 2 shows an example where the front handle 42 comprises a lateral portion 46 substantially parallel to the pivot plane 28, and a transverse portion 48 orthogonal to the pivot plane 28. The transverse portion 48 of this example may be substantially cylindrical, thus, when the bracket 24 is clamped to the transverse portion 48, the transverse portion 48 easily forms part of the pivot defining a pivot axis 50 orthogonal to the pivot plane 28. In one example, the pivot axis 50 is parallel to the cutting plane 30 and lateral axis 14 offset therefrom.

To make the cutting guide durable enough to withstand the use such tools normally encounter, the bracket 24 may be formed of a rigid and impact resistant material such as metal, aluminum, steel, carbon fiber, ceramic, silicone, or combinations thereof, or other material to additionally protect the light emitter 26 from impact damage.

Looking to FIG. 1 is shown three examples (52, 54, 56) of rotational position 58 of the light emitter 26 in the pivot plane 28. These three positions (52, 54, 56) correspond to three desired lengths (60, 62, 64) of the item 34 to be cut when the blade 32 is substantially orthogonal to the item 34 to be cut, positioned a specific distance from the item 34 to be cut, and the light beam 66 contacts the distal end of the item 34 at a point 68. In this example, the rotational position 58 has been selected to the example 54, resulting in a cut length 62 when the distal end of the blade 32 is positioned as shown longitudinally relative to the item 34 or log.

In other terms, the user can position the blade 32 orthogonal to the item 34 with the light emitter 26 a specified distance 70 from the item 34. The user then moves the saw 22 or item 34 laterally with the distal end of the blade 32 very near the item to be cut until the light beam 66 shines on the distal end of the item 34, a previous cut, or other mark, and then moves the saw blade 32 in the cutting plane 30 to cut the item 34. In various ranges, the saw blade 32 should be touching, within ¼" within ½" within %" within 1" within 2", etc. and ranges thereof of the item 34. Provided that the distance from the distal end of the blade to the item 34 is consistent, and the relative angle of the cutting plane 30 to the item 34 is consistent, the cut desired length 60, 62, will be substantially repeated. Accuracy within h", ½", %", 1", 2" and ranges thereof being often acceptable in cutting of firewood and other applications.

In the example shown in FIG. 4 the light emitter comprises a light emitting structure (LES) 72 such as a light emitting diode (LED), focused light emitter, laser, or other device within a housing 74. In one example batteries, electronics, and optionally a re-charging port 76 are contained within the housing 74. The housing 74 comprising an outer surface or structure protecting the inner components from damaging impact, fluid entry, temperature fluctuations, and engaging a light clamp 78 portion of the bracket 24. In one example, the housing 74 is sealed, water and/or airtight to protect the components therein. The partial cutaway view of FIG. 4 shows this well.

In one example, the LES 72 is a red diode laser emitting coherent light in the 650 nm range. The wavelength (measured in nanometers (nm)) of the light defines the color that we perceive. The most common laser pointers are red (630 nm-670 nm), green (520 nm and 532 nm) and violet (405 nm and 445 nm). Any of these, and others may be used. In testing in the field, it was found that a red laser in the range of 630 nm-670 nm was most easily seen by the person cutting.

The re-charging port 76 may be a USB port (USB Type A, USB Type B and USB Type C, etc.) or two-prong plug, or single prong multiple ring plug.

In one example, the housing 74 protects the delicate components of the re-charging port 76. The housing 74 may also protect an attached rechargeable battery system 77 and any connections to the re-charging port 76 and light emitting structure 72. The rechargeable battery system 77 may include a rechargeable battery with an 8, 12, or longer life when powering the light emitting structure 72. A movement switch, push button switch, or other may be used to turn the light emitting structure 72 on when in use. For example, a mercury or other switch may activate the unit for a specified time, (20 min, 90 min, an hour, eight hours, and ranges of these combinations) and then turn off if no movement is detected.

In the example shown, the light clamp 78 is a simple friction clamp, wherein a fastener 80 having threads 82 and a tool engaging head 84 pass through a surface defining a void $84^1$ and engage female threads 86. Rotation of the fastener 80 relative to the female threads thus exerts clamping force of the light clamp 78 or releases the clamping force of the light clamp 78 against the light emitter 26. Snap in, ratcheting, bayonet, threaded, or other fastening clamps may alternatively be used to connect the light emitter 26 to the bracket 24.

Similarly, the bracket 24 comprises a saw clamp 88 configured to removably and rotatably clamp the bracket 24 to the saw 22. In this example the saw clamp 88 comprises a first portion 90 connected to or formed as a unitary structure with the light clamp 78, and a second portion 92. In this example, fasteners 80 are provided and configured to pass through surfaces defining voids 94 and engage threaded voids 96. Again, rotation of the fastener 80 relative to the female threads 96 thus changes clamping force of the saw clamp 88 against the handle 42 or other portion of the saw 22. Rotation of the fasteners 80 increases or decreases the clamping force of the saw clamp 88.

The first portion 90 and second portion 92 of the saw clamp 88 may comprise female cylindrical surfaces 98/100 which frictionally engage the outer surface of the handle 42 and prior to tensioning of the fasteners 80, allows rotation of the saw clamp 88 relative to the handle 42. This allows the clamp to be rotated without any limitations as to the rotational angle 58.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicant's general concept. The invention illustratively disclosed herein suitably may be practiced in the absence of any element which is not specifically disclosed herein.

What is claimed is:

1. A method for cutting an item to a prescribed length, the method comprising:

providing a cutting guide, comprising:

a bracket configured to be removably rotationally attached to the saw;

the bracket, comprising:

a light clamp and a saw clamp, the saw clamp includes a first portion and a second portion wherein the first portion forms a unitary structure with the light clamp;

a sealed housing:

the light clamp includes a female threaded void configured such that a threaded fastener having a tool engaging head can pass therethrough;

the sealed housing, comprising:

a light emitter including a light emitting structure;

a rechargeable battery;

a USB port for recharging the rechargeable battery;

the sealed housing removably attached to the bracket via the light clamp whereby rotation of the threaded fastener against the female threaded void exerts a clamping force of the light clamp against the light emitter or releases the clamping force of the light clamp against the light emitter;

the first portion of the saw clamp and the second portion of the saw clamp each includes female threaded surfaces defining voids configured to receive fasteners;

the first portion of the saw clamp and the second portion of the saw clamp each include female cylindrical surfaces such that the first portion of the saw clamp and the second portion of the saw clamp is frictionally engaged about an outer surface of a cylindrical grasping handle of the saw by way of tensioning of the fasteners engaged with the female threaded surfaces defining voids of each of the first portion of the saw clamp and the second portion of the saw clamp such that the bracket by way of the saw clamp is removably and rotationally attached to the grasping handle such that rotation of the fasteners relative to the female threaded surfaces defining voids increases or decreases the clamping force of the saw clamp against the grasping handle allowing rotation of the saw clamp without limitation about the grasping handle; and thereby the rotation of the saw clamp enables the light emitter to be rotated in a pivot plane about a pivot axis parallel to the cutting plane;

determining a desired cutting length of the item to be cut;

determining a desired cutting angle of the cutting guide relative to the saw based on the desired cutting length;

adjusting the cutting guide to a desired cutting angle;

turning on the light emitter for a specified time by way of a switch;

laterally aligning the saw such that the light emitter projects light on the distal end of an item to be cut when the light emitter is positioned a pre-determined longitudinal distance from the item; and moving the saw in a cutting plane so as to pass the blade through the item so as to cut the item to the desired cutting length.

2. A cutting guide for a saw having a blade lying in and defining a cutting plane, the cutting guide, comprising:

a bracket configured to be removably rotationally attached to the saw;

the bracket, comprising:

a light clamp and a saw clamp, the saw clamp includes a first portion and a second portion wherein the first portion forms a unitary structure with the light clamp:

a sealed housing:

the light clamp includes a female threaded void configured such that a threaded fastener having a tool engaging head can pass therethrough:

the sealed housing, comprising:

a light emitter including a light emitting structure:

a rechargeable battery;

a USB port for recharging the rechargeable battery:

the sealed housing removably attached to the bracket via the light clamp whereby rotation of the threaded fastener against the female threaded void exerts a clamping force of the light clamp against the light emitter or releases the clamping force of the light clamp against the light emitter;

the first portion of the saw clamp and the second portion of the saw clamp each includes female threaded surfaces defining voids configured to receive fasteners;

the first portion of the saw clamp and the second portion of the saw clamp each include female cylindrical surfaces such that the first portion of the saw clamp and the second portion of the saw clamp is frictionally engaged about an outer surface of a cylindrical grasping handle of the saw by way of tensioning of the fasteners engaged with the female threaded surfaces defining voids of each of the first portion of the saw clamp and the second portion of the saw clamp such that the bracket by way of the saw clamp is removably and rotationally attached to the grasping handle such that rotation of the fasteners relative to the female threaded surfaces defining voids increases or decreases the clamping force of the saw clamp against the grasping handle allowing rotation of the saw clamp without limitation about the grasping handle;

and thereby the rotation of the saw clamp enables the light emitter to be rotated in a pivot plane about a pivot axis parallel to the cutting plane.

3. The cutting guide as recited in claim 2, wherein the saw is a chain saw comprising a motor, a chain bar, and the blade comprising a chain with sharpened cutting teeth.

4. The cutting guide as recited in claim 2, wherein the pivot axis is defined by the grasping handle of the saw to which the saw clamp is removably rotationally attached.

5. The cutting guide as recited in claim 4, wherein the saw clamp comprises a compression clamp configured to clamp to the grasping handle of the saw.

6. The cutting guide as recited in claim 2, wherein the light clamp is a compression clamp configured to hold the light emitter in place.

7. The cutting guide as recited in claim 2, wherein the light emitter comprises a laser.

8. The cutting guide as recited in claim 7, wherein the laser emits light in the 630 nm to 670 nm range.

* * * * *